US005611541A

United States Patent [19]

Paino

[11] Patent Number: 5,611,541

[45] Date of Patent: Mar. 18, 1997

[54] METHOD OF PLAYING A BALL GAME

[76] Inventor: Robert Paino, 469 Highland Ave., Walden, Mass. 02148

[21] Appl. No.: 518,663

[22] Filed: Aug. 24, 1995

[51] Int. Cl.[6] ..... A63B 43/04; A63B 37/08

[52] U.S. Cl. ..... 273/317; 273/DIG. 30; 473/573; 473/594

[58] Field of Search ..... 273/DIG. 8, DIG. 30, 273/65 A, 58 F, 118, 127 R, 128 R, 128 A, 317, 411, 415, 427, 428

[56] References Cited

U.S. PATENT DOCUMENTS

| | | | |
|---|---|---|---|
| 431,211 | 7/1890 | Merrill | 273/415 X |
| 1,754,937 | 4/1930 | Comstork | 273/DIG. 8 |
| 1,900,544 | 3/1933 | Craig | 273/65 A |
| 3,480,280 | 11/1969 | Gamertfelder | 273/106 |
| 3,628,793 | 12/1971 | Mudloff | 273/105 |
| 3,924,856 | 12/1975 | Dekan et al. | 273/415 |
| 4,011,611 | 3/1977 | Lederman | 273/58 F X |
| 4,938,485 | 7/1990 | Hockridge et al. | 273/401 |
| 5,224,704 | 6/1993 | Snell | 273/65 EC |
| 5,324,042 | 6/1994 | Demas | 273/346 |
| 5,492,320 | 2/1996 | Hoffman et al. | 273/415 |

*Primary Examiner*—George J. Marlo

[57] ABSTRACT

The present invention relates to a method of playing a ball game with a soft, malleable ball. The game is particularly suited to play on a beach or other soft surface such as a lawn. The method of playing the game requires each player to accurately throw or roll this ball with the specific purpose of landing closest to an object ball. Scoring is kept over each round of play and the player exhibiting the greatest skill in placing his or her ball nearest to the object ball earns the greatest number of points. The player having the most points at the end of the game wins.

3 Claims, 2 Drawing Sheets

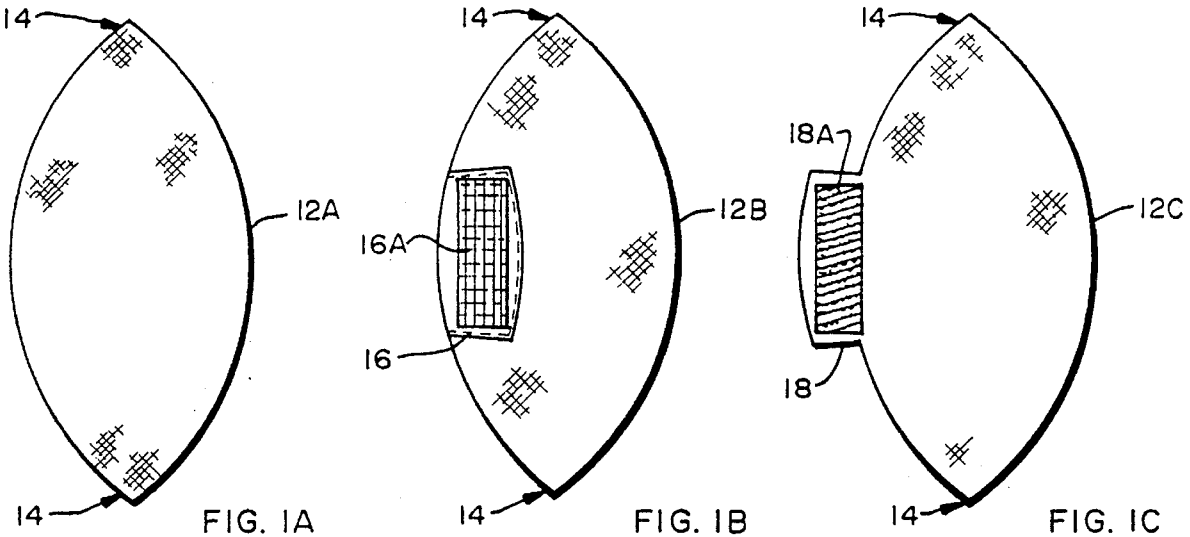
FIG. 1A
FIG. 1B
FIG. 1C
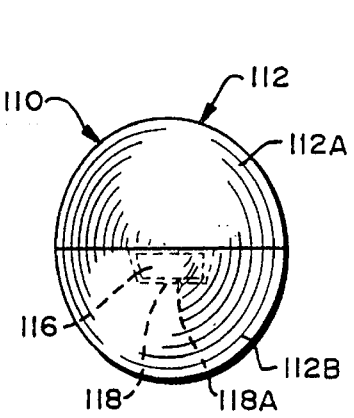
FIG. 4
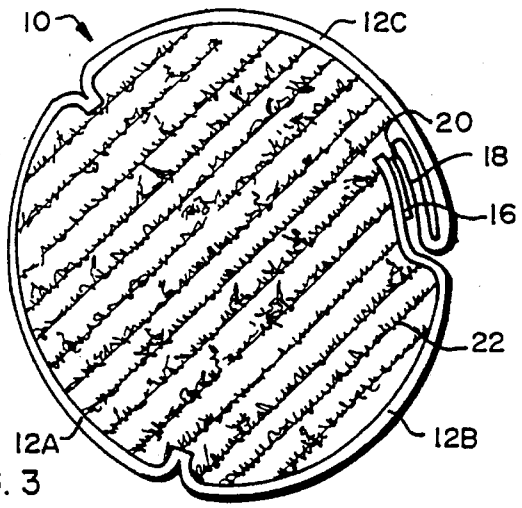
FIG. 3
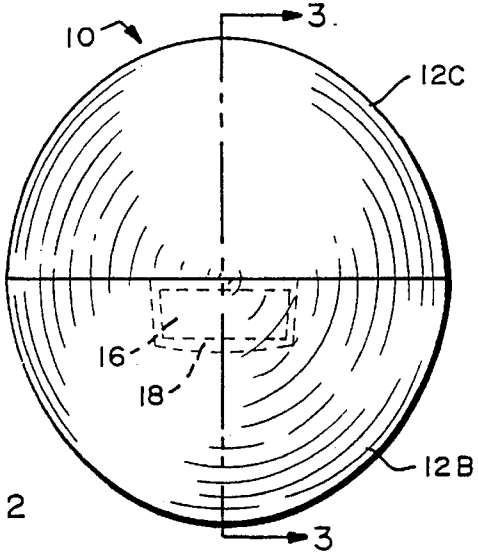
FIG. 2

METHOD OF PLAYING A BALL GAME

BACKGROUND OF THE INVENTION

1. Field of the Invention

The present invention relates to a ball game in which players through concentration, skill, and good luck attempt to place by throwing or rolling a game ball in closer proximity to an object ball than their opponent.

2. Description of the Prior Art

Balls and games associated with them have a long history. One present game that bears a resemblance to the present invention is bocci ball, a game which is played with two rigid balls and generally on a hard surface such as clay, packed soil or lawns. In fact bocci must be played on such a surface in order for the balls used in play to roll in the manner intended. The present invention may readily be used on such hard surfaces as mentioned above and also on soft surfaces such as sand, and loosely packed soil.

Furthermore, the bocci ball can be cumbersome to transport, since the balls are constructed of rigid material and cannot be stored in small spaces, whereas the game ball needed in the present invention is pliable, such pliability making it safer to use and creating further strategies of play not possible in bocci ball games using rigid balls.

Numerous innovations for a Ball Games similar to bocci ball have been provided in the prior art that are adapted to be used. Even though these innovations may be suitable for the specific individual purposes to which they address, they would not be suitable for the purposes of the present invention as heretofore described.

SUMMARY OF THE INVENTION

More particularly, the present invention relates to the two balls each of which can be made of various rigid or pliable materials and which is originally hollow. This game ball is known as a "Beachee Ball" and the object ball is known as the "Weasel". Furthermore, the Beachee ball may be filled with a variety of materials such as sand, water, foam rubber, rags, rice, beans and any number of other materials. The Beachee ball is four inches in diameter. The "Weasel" is constructed in a similar fashion to that of the Beachee ball and is two inches in diameter. Both the Beachee ball and the Weasel are primarily intended for use at a beach but are not limited to a particular type of place. Further the object of the game associated with the two balls is to score points by tossing, pitching, or rolling the Beachee ball at the Weasel. Through the use of skill, practice, and good luck, a player attempts to place his or her Beachee ball closest to the Weasel. Various scoring schemes are employed to set scores for closest to the Weasel as well as other placements of the Beachee ball and Weasel. The team to score 16 points wins the game.

The present invention relates to a method of playing a bocci-like game which can be played on loose or uneven soils such as beaches, and is referred to as "Beachee Ball" or alternatively "Coconut Ball Game" or alternatively as the "Sandy Island Ball Game" or alternatively as the "Caribbean Beach Sand Ball Game".

The game ball and the object ball of the present invention each have a hollow interior which can be filled with a variety of materials such as sand, foam rubber, rice, water, and other suitable materials. The ball itself can be made of rigid or pliable materials. Some examples of the former are plastic or wood. Some examples of the latter are leather or rubber. The ball can be made as a one piece unit with a hole used for filling the hollow interior with some filler material. The hole is closed with a flap. The ball can also be made as a two-piece unit, whereby the two pieces are joined together by a fastening means such as a zipper, laces, or snaps.

In contrast to the bocci ball and the game, bocci ball, the present invention is designed to be played on a variety of surfaces. The bocci ball is generally limited to hard surfaces such as lawns, packed soil, or clay. The present invention may readily be used on such hard surfaces as mentioned and also on soft surfaces such as sand, and loosely packed soil.

The method of playing the game requires the use of a plurality of game balls and an object ball. Each of the balls are envisioned to have a hollow interior which can be filled with a variety of materials such as sand, foam rubber, rice, water, or other suitable material subject to non-elastic collision.

The ball of the present invention is also much lighter than the traditional bocci ball and as such makes it much easier to carry from place to place. Since it may be emptied of its filling, the ball of the present invention may be packed away in a relatively small space as compared to the bocci ball and other balls having a similar purpose.

The method and manner of playing this game although applicable to people of all ages is especially suitable for children since the game avoids the use of hard bocci balls commonly found in the game bearing the same name.

Furthermore, the way in which a team may score points differs from bocci ball in that in the game of the present invention, a person may score points by rolling a "leaner", which is to say that a Beachee Ball that leans against a Weasel scores points. Additionally, a score may be obtained by throwing a "sitter" in which the Beachee Ball land on top of the weasel, a feat not possible with the bocci Ball.

Field tests of the present invention have indicated an interest in the present invention ball and the game designed to be played with it, demonstrating that the ball is a unique contribution to gaming in general and in particular games which use balls.

Accordingly, it is an object of the present invention to provide a game ball and an object ball each of which is composed of fabric and has a hollow interior.

It is a further object of the present invention to provide a game ball and an object ball each of which can be filled with various types of material via an opening. The opening is composed of two sealing flaps. One sealing flap is an extension of the fabric panel of the ball and is known as the fixed flap. Attached to the outer surface of the fixed flap is a strip of hook and loop or other fastener-type material. A second flap is also an extension of the fabric panel of the ball and is known as the free flap. Attached to the outer surface of the free flap is hook and loop or other fastener-type material. The free flap is folded over such that the hook and loop surface is opposing hook and loop surface of the fixed flap. The hole may be then closed by pressing the two opposing velcro faces together. The aforementioned flaps may also employ other means by which the opening may be closed. It is possible to use laces, snaps, and draw strings, to name but a few other means of closing the opening.

It is a further object of the invention to provide a game ball and an object ball which is made of two parts whereby the two parts may be filled with various types of material and then joined together by various means including laces, snaps, draw strings and other such means as would allow the closing of the two parts of the game ball.

It is a further object of the present invention to provide a game ball and an object ball where the fabric is a pliable material, this characteristic giving the game ball and the object ball the ability to be compressed after the fillings are removed and further reducing the likelihood of injury to a person if hit by such balls.

It is a further object of the present invention to provide a game ball and an object ball where the pliable fabric is rubber or a rubber-like material whereby a ball made of such material can be submerged under water so that water will fill the ball and seal the opening by virtue of pressure exerted on a sealing flap by the water inside the ball.

It is a further object of the present invention to provide a game ball and an object ball where the fabric is rigid.

It is a further object of the present invention to provide a method of using the game ball and the object ball, this method known as a game.

It is a further object of the present invention to provide a game having the following rules:

1. The object of the game is to score points by tossing, pitching, or rolling the sand filled Beachee balls, at the weasel. The first player or team to score 16 points wins the game.

2. There are two teams and the number of players is one, two or three per team.

a. For one player per team, each player controls and tosses four Beachee balls.

b. For two players per team, each player controls and tosses two Beachee balls.

c. For three players per team, one player will toss two Beachee balls.

The other players toss one. A player may be designated as the one to toss the two Beachee balls or this designation may rotate from teammate to teammate.

3. To start the game, a person from one of the teams may flip a coin with different icons on each side of the coin and the person choosing the icon that faces upward after the flip goes first. Alternatively, a person from each team may toss a beachee ball at a common object, whereby the team tossing the beachee ball closest to the common object goes first.

4. The game is won by the first team to score sixteen points.

5. To start the game, a player on a team tosses the object ball, Weasel, onto the play field. The same player then tosses the first Beachee ball at the Weasel. If the Beachee ball lands within a two foot diameter of the Weasel then that player/team is in a position to score a point, which is in its favor or "Advantage". Whether the first attempt is inside a two foot diameter circle around the Weasel or not, a player from the other team must make their first attempt to get their Beachee Ball closer to the Weasel. If they do this, they then have the advantage and a possible point. If they are successful on their first toss then play reverts back to the other player/team. If they are not successful on the first attempt they must continue tossing until they are. At that point they stop tossing and hold any Beachee Balls they have left in reserve in hope that the other team will exhaust its remaining attempts to land their Beachee Ball closer to the Weasel. More concisely, the team that is closer to the Weasel has the advantage and the opportunity to score points. They then hold whatever balls it has in reserve. That forces the other team to use its remaining chances to toss their Beachee Balls until they are closer, or have used all of its four Beachee Balls attempting to get closer to the Weasel. Near, or at the end of a round of play either team having balls in reserve can score points at will without the other team having any opportunity to play on in that round. The team that gets at least one of its balls closest to the Weasel, provided that the ball's distance from the Weasel's outside diameter is within two feet, scores one point. The team having its Beachee ball the closest to the Weasel will receive one additional point for each of its balls that is closer to the Weasel than any other team's balls. If no team has any of its balls within a two foot diameter of the Weasel, then no points shall be scored in that round. There are two other ways in which a team can score points: the first which is called a "Leaner", is worth two points, and is obtained if any Beachee ball comes to rest on or touch the Weasel. Two or more teams having the same number of leaners will result in no points being awarded. However if one team has more Leaners than another team this team will receive two points for every extra Leaner. The second way, called a "Sitter", is worth three points, and is obtained when a Beachee ball comes to rest on top of and completely encompasses the Weasel. A Sitter need not touch the Weasel. It need only encompass it.

Brief List of Reference Numerals Utilized in the Drawing

10—game ball 10
12A—first fabric panel 12A
12B—second fabric panel 12B
12C—third fabric panel 12C
14—end 14
16—free flap 16
18—fixed flap 18
20—valve 20
22—sand 22
24—player 24
110—game ball 110
112A—first fabric panel 112A
112B—second fabric panel 112B
114—end 114
116—free flap 116
118—fixed flap 118
120—valve 120

BRIEF DESCRIPTION OF THE PREFERRED EMBODIMENT

FIG. 1A is side view of a first fabric panel.

FIG. 1B is a side view of a second fabric panel.

FIG. 1C is a side view of a third fabric panel.

FIG. 2 is a end view of the game ball.

FIG. 3 is a cross sectional view of game ball of FIG. 2 along line 3—3.

FIG. 4 is a top view of the object ball.

DETAILED DESCRIPTION OF THE PREFERRED EMBODIMENT

Figure 6:
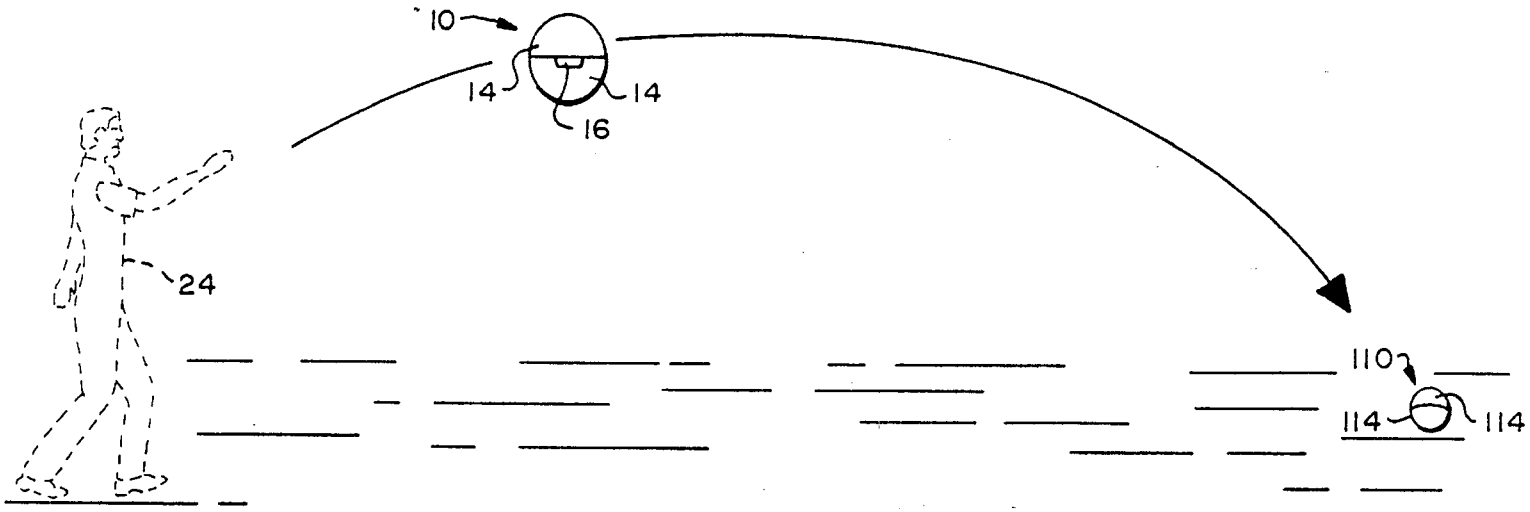
FIG. 6 is a side view of the game being played exhibiting a player throwing a game ball.

Referring to FIGS. 1A, 1B, 1C , 2 and 3, the game ball 10 is constructed of three pliable fabric panels: first first fabric panel 12A, second second fabric panel 12B, and third third fabric panel 12C. One end of first fabric panel 12A is joined to one end of third fabric panel 12C. The other end of third fabric panel 12C has a lip which extends from the panel. This lip is folded back on itself. The folded part is then stitched forming fixed flap 18. A strip of adhesive is then attached to the outer surface of the folded part forming a first adhesive surface 18C. One end of second second fabric panel 12B is joined to the free end of first first fabric panel 12A. On the free end of second fabric panel 12B, a section of the fabric is used to form a lip which forms a free flap 16. An adhesive is stitched onto the outer surface of flap 16, forming a second adhesive surface 16A wherein fixed flap 18 and free flap 16 can be adhesively connected. The three fabric panels are made into a ball having a hollow interior by conventional means known to those skilled in the art. When first adhesive surface 18A and second adhesive surface 16A are pressed together, they form a seal defined as valve 20. Hollow interior 22 is filled with a variety of materials where the preferred material is sand. After hollow interior 12 is filled, the flaps are sealed and the ball is ready for use.

In a preferred embodiment of the present invention, the adhesive used is velcro. Further, the velcro is stitched to the fabric panels.

It is also it is preferred that the color of the first first fabric panel 12A and second second fabric panel 12B and third third fabric panel 12C be the same.

It is another preferred embodiment of the present invention that the diameter of the ball be four inches.

In another embodiment of the present invention the flaps may be laced together, drawn together with draw string, snapped together or zippered.

In another embodiment of the present invention the number of fabric panels may be more or less than three.

In another embodiment of the present invention, the ball may be constructed out of rigid fabric, such as plastic or wood.

Referring to FIG. 4, object ball 110 is constructed of two pliable fabric panels: first fabric panel 112A, and second fabric panel 112B, each having two free ends. Each of the fabric panels are joined together at one end of each panel by conventional means known to those skilled in the art and made to form a ball having a hollow interior. At the free end of first fabric panel 112C is a lip which extends from the panel. This lip is folded inwardly so that the folded portion makes contact with the inner surface of panel 112C. The folded part is then stitched to that part of panel 112C with which it is in contact, forming fixed flap 118. A strip of adhesive is then attached to the outer surface of the folded part forming a first adhesive surface 118A (not shown). Second fabric panel 112A is positioned next to first fabric panel 112 such that the end of panel 112B forms a free flap 116. An adhesive is stitched onto the outer surface of flap 116, forming a second adhesive surface 116A (not shown). When first adhesive surface 118A and second adhesive surface 116A are pressed together, they form a seal defined as valve 120 (not shown). Hollow interior 122 (not shown) is filled with a variety of materials where the preferred material is sand. After hollow interior 122 is filled, the flaps are sealed and the ball is ready for use.

In a preferred embodiment of the present invention, the adhesive used is velcro. Further, the velcro is stitched to the fabric panels.

It is also it is preferred that the color of the first fabric panel 112A and second fabric panel 112B be different.

It is another preferred embodiment of the present invention that the diameter of the ball is two inches.

In another embodiment of the present invention the flaps may be laced together, drawn together with draw string, snapped together or zippered.

In another embodiment of the present invention, the ball may be constructed out of rigid fabric, such as plastic or wood.

Figure 5:
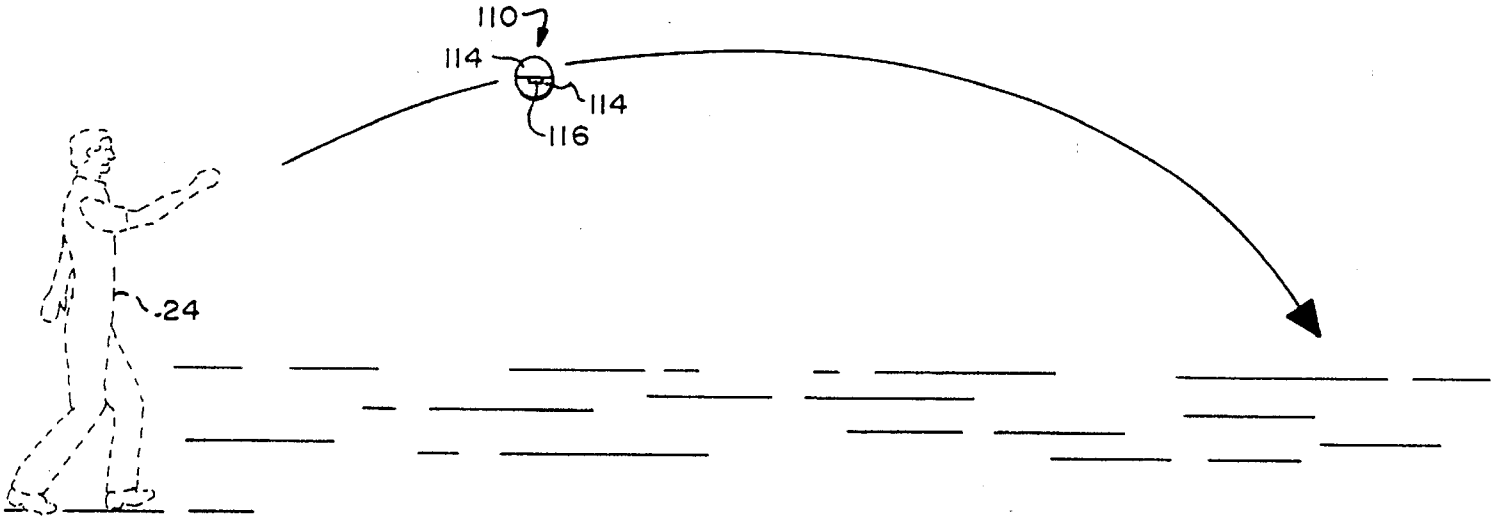
FIG. 5 is a side view of the game being played exhibiting a player throwing an object ball.

Referring to FIGS. 5 and 6 which describe a method of playing the game Beachee Ball, player 24 from the first team tosses object ball 110 a distance from where player 24 is standing. Next, player 24 or another player from the same team tosses game ball 10 towards object ball 110 and if game ball 10 lands within two feet of the outside diameter of object ball 110, the team of player 24 has the advantage and is in a position to score a point. Whether the first attempt is inside a two foot diameter circle around object ball 110 or not, a player from the second team must make their first attempt to get a game ball 10 closer to object ball 110. If they do this, they then have the advantage and a possible point. The team who has at least one ball closer to object ball 110 than the other team scores one point. This team may get one additional point for every ball that is closer to object ball 110 than any ball form the second team. A team can score two points if it tosses game ball 10 such that it touches object ball 110. This is called as leaner. A team can score three points if it toss game ball 10 such that it covers object ball 110. The first team to score 16 points wins.

It will be understood that each of the elements described above, or two or more together, may also find a useful application in other types of constructions differing from the type described above.

While the invention has been illustrated and described as embodied in a Beachee Ball and Beachee Ball Game, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of playing a bocci-like ball game comprising:

selecting a first player to manually propel a deformable and collapsible object ball some arbitrary distance from him or herself;

manually propelling said object ball, wherein said player attempts to throw, roll, or otherwise manually propel said object ball to a location which said player believes to be outside an opponent player's capability to reach by said opponent player's manual propulsion of a game ball;

manually propelling a plurality of deformable and collapsible game balls toward said object ball, so that said game ball comes to rest at a location as close as possible to said object ball, wherein said first player and said opponent player each possess an equal number of game balls out of the plurality of game balls; whereby whichever player, the first player or the opponent player who successfully lands his or her game ball in closest proximity to said object ball forces said other player to manually propel their game balls in an attempt to be in closer proximity to said object ball;

attempting to land said deformable and collapsible game ball atop said deformable and collapsible object ball whereby a number of points are scored;

attempting to hit said deformable and collapsible object ball with one of said deformable and collapsible game balls to place at least one of that player's game balls in closer proximity to said object ball than the other player; and scoring points after all game balls are exhausted; wherein a specific number of points are awarded for the player who has placed their game ball atop the object ball if any such player exists, for the player who places their game ball in contact with the object ball if any such player exists, and for the player who has placed at least one of their game balls closest to the object ball.

2. A method of playing a bocci-like game on a loose or granular surface comprising:

filling a plurality of sealable hand-held containers with a quantity of granular or liquid material to a desired level;

temporarily sealing said material within said containers thereby creating a plurality of collapsible, deformable ball-like objects;

manually propelling a first of said collapsible, deformable ball-like objects some distance, said first collapsible, deformable ball-like object differing from the other of said collapsible, deformable ball-like objects in that it is significantly smaller than said other collapsible, deformable ball-like objects;

manually propelling in turn the remaining larger collapsible, deformable ball-like objects toward said first ball-like object; wherein each player or team of such players possessing a quantity of said remaining larger collapsible, deformable ball-like objects attempts to place said remaining larger collapsible, deformable ball-like objects closer to said first collapsible, deformable ball-like object than the other player or team of such players;

scoring points based on proximity of placement of said remaining larger collapsible, deformable ball-like objects to said first collapsible, deformable ball-like object; wherein a greater number of points is awarded the closer the first and remaining ball-like objects reside or contact one to the other with the greatest number of points awarded if one of said remaining ball-like objects come to rest upon said first ball-like object; and emptying said plurality of sealable hand-held containers when said game is finished.

3. A method of playing a bocci-like game on a loose or granular surface according to claim 2 further comprising playing on sand wherein the plurality of sealable hand-held containers are first filled with said sand upon which play is to occur as well as utilizing natural and artificial fixtures appurtenant to the location selected for playing said game.

* * * * *

UNITED STATES PATENT AND TRADEMARK OFFICE

CERTIFICATE OF CORRECTION

PATENT NO. : 5,611,541

DATED : March 18, 1997

INVENTOR(S) : Robert Paino

It is certified that error appears in the above-indentified patent and that said Letters Patent is hereby corrected as shown below:

On the title page, Item [76], change " Walden " to --Malden --.

Signed and Sealed this

Seventh Day of October, 1997

*Attest:*

*Attesting Officer*

BRUCE LEHMAN

*Commissioner of Patents and Trademarks*